US008505117B2

(12) United States Patent
Park

(10) Patent No.: US 8,505,117 B2
(45) Date of Patent: Aug. 13, 2013

(54) HOOD AND SCARF COMBINATION

(75) Inventor: David Y. Park, La Palma, CA (US)

(73) Assignee: Scoodeez, LLC, La Palma, CA (US)

( * ) Notice: Subject to any disclaimer, the term of this patent is extended or adjusted under 35 U.S.C. 154(b) by 0 days.

(21) Appl. No.: 13/276,315

(22) Filed: Oct. 18, 2011

(65) Prior Publication Data

US 2012/0204323 A1 Aug. 16, 2012

Related U.S. Application Data

(60) Provisional application No. 61/442,613, filed on Feb. 14, 2011.

(51) Int. Cl.
*A42B 1/04* (2006.01)

(52) U.S. Cl.
USPC ..... 2/202; 2/203; 2/207

(58) Field of Classification Search
USPC ..... 2/202, 203, 204, 205, 84, 209.11, 2/208, 172, 181, 181.4, 207, 69.5, 88, 91, 2/171, 206
See application file for complete search history.

(56) References Cited

U.S. PATENT DOCUMENTS

| | | | | | |
|---|---|---|---|---|---|
| 202,262 | A * | 4/1878 | Isidor | 2/98 |
| 265,536 | A * | 10/1882 | Oberst | 2/84 |
| 364,762 | A * | 6/1887 | King | 2/84 |
| 822,986 | A * | 6/1906 | Rochet | 2/172 |
| 899,334 | A * | 9/1908 | Seitzman | 2/10 |
| 1,316,778 | A * | 9/1919 | Ensten | 2/203 |
| 1,399,523 | A * | 12/1921 | Sable | 2/203 |
| 1,467,718 | A * | 9/1923 | Entrikin et al. | 2/88 |
| 2,039,478 | A * | 5/1936 | Ensten | 2/203 |
| 5,115,517 | A * | 5/1992 | Ferguson et al. | 2/203 |
| 5,611,095 | A * | 3/1997 | Schneider | 5/482 |
| D476,133 | S * | 6/2003 | Weidenhaupt | D2/600 |
| 7,178,185 | B1 * | 2/2007 | Nattler | 5/482 |
| 7,305,716 | B1 * | 12/2007 | Richards | 2/114 |
| 8,225,422 | B1 * | 7/2012 | McSparron | 2/67 |
| 2005/0039242 | A1 * | 2/2005 | Edmondson | 2/207 |
| 2012/0137407 | A1 * | 6/2012 | Dimuzio | 2/207 |

* cited by examiner

*Primary Examiner* — Amy Vanatta

(57) ABSTRACT

A hood and scarf combination is disclosed. A hood portion includes fasteners. A scarf portion includes one or more sets of fasteners disposed on the scarf portion to receive the hood fasteners along various positions along the scarf portion.

18 Claims, 6 Drawing Sheets

HOOD AND SCARF COMBINATION

CROSS-REFERENCE TO RELATED APPLICATION

This application claims the benefit of priority under 35 U.S.C. 119(e) of U.S. Provisional patent application No. 61/442,613, filed Feb. 14, 2011, which is herein incorporated by reference.

BACKGROUND

The disclosure relates to an item of apparel and more particularly, to a hood and scarf combination.

Apparel can be sought as much as for its functional aspects as its fashionable features. For example, there exists a hood with a scarf sewn linearly along the hood's base that some commonly refer to as a hooded scarf. Known hooded scarves can be handmade or manufactured by cutting an elongated fabric into an unfinished scarf and sewing the scarf into a fixed position onto the hood. One aspect of sewing the scarf linearly fixated onto the hood can create a bunched effect at the rear base of the hood portion so that the hood does not sit aesthetically shaped onto a user's head. Additionally, the fixed scarf may limit the fashionable aesthetics of the hooded scarf.

As can be seen, there is a need for a more flexible hood and scarf combination that may provide flexible looks for the user.

SUMMARY

A hooded scarf comprises a hood portion, a plurality of fasteners on the hood portion, a scarf portion, and a plurality of fasteners on the scarf portion. The hooded scarf combination may include at least one more fastener on the scarf portion than the plurality of fasteners on the hood portion.

A hooded scarf comprises a hood and a plurality of fasteners attached to the hood. At least one of the fasteners is positioned non-linearly from the remaining fasteners on the hood. The hooded scarf combination may also include a scarf including a first end and a second end and a plurality of fasteners attached to the scarf. At least one of the fasteners on the scarf is positioned non-linearly from the remaining fasteners on the scarf. At least some of the plurality of fasteners on the scarf are aligned to couple with the plurality of fasteners on the hood.

A hooded scarf comprises a hood, two or more fasteners attached to the hood, a scarf, and two or more sets of fasteners attached to the scarf, configured respectively to receive the two or more fasteners attached to the hood. A first set of the fasteners attached to the scarf is disposed on a first position of the scarf, coded to designate the first position. A second set of the fasteners is disposed on a second position of the scarf, coded to designate the second position.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like or similar components are labeled with identical element numbers for ease of understanding.

The subject technology of this disclosure relates generally to apparel. Aspects of the subject disclosure are more particularly, a hood and scarf combination.

While adjustability may not be typically associated with the use of a hooded scarf, aspects of the subject disclosure may provide flexibility in the positioning of a hood along the length of a scarf, flexibility in the manner of wear, and flexibility in the mix and matching of scarf portions to hood portions. A hood may also be interchangeably referred to as a hooded portion. A scarf may also be interchangeably referred to as a scarf portion.

Figure 1:
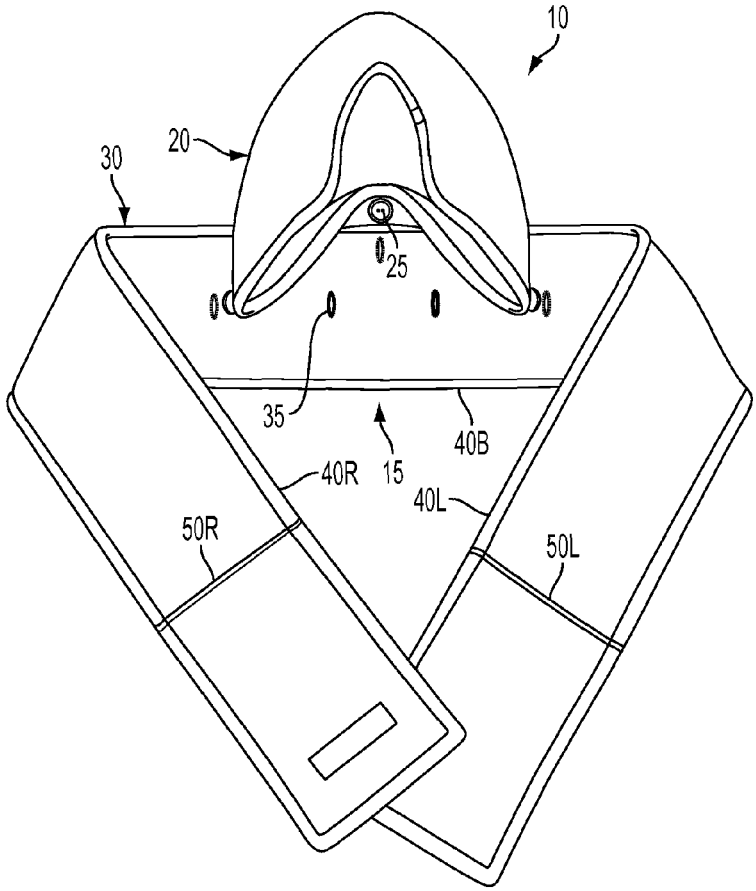
FIG. 1 is a front view of a hood and scarf combination in accordance with an exemplary aspect of the subject disclosure.

Referring to FIG. 1, a hood and scarf combination 10 is shown according to an exemplary embodiment. In general, the hood and scarf combination 10 includes a hood portion 20 and a scarf portion 30 that are fastenable to one another through a fastening system 15 as disclosed in the following. The hood portion 20 includes one or more fasteners 25. The scarf portion 30 includes one or more fasteners 35 configured to couple to the fasteners 25. As viewed from the perspective of a user, the scarf portion 30 includes a right end 40R, a left end 40L, and a back or base portion 40B. FIG. 1 also shows that the scarf portion 30 is preferably substantially rectangular and that the length of the scarf portion 30 may be at least nine times longer than the width portion 30. Furthermore, the scarf portion 30 may include a rightside pocket 50R disposed on the right end 40R and a leftside pocket 50L disposed on the left end 40L. While the pockets 50R and 50L are illustrated on an outward facing side of the scarf portion 30, it will be understood that the pockets may also be disposed on an inward facing side.

Referring now to FIGS. 2A-2D, the hood portion 20 is shown in various views in accordance with aspects of the subject disclosure. The hood portion 20 may include, from the perspective of a user, a right side 23 and a left side 27. The right side 23 and the left side 27 may be attached to one another along a central seam 21. The rear edge of the seam 21 may define a centerline running from a top edge 28 of the hood portion 20 down to a rear base edge 26. The rear base edge 26 may include edge ends 22. The edge ends 22 may also be considered hood corners. The top edge 28 may include at a highest, rear point, a pinnacle 29. An upward taper 24*a* along the rear base edge 26 of the hooded portion 20 may peak at an apex 24. Fasteners 25 may be attached to the rear base edge 26. The fasteners 25 may be positioned based on the desired fit of the hood portion 20 on a wearer. For example, fasteners 25 may be attached to the edge ends 22 and the apex 24 providing for the pinnacle 29 to rest on the neck and shoulder blade of a user pointing downward when the head is uncovered rather than allowing rear base edge 26 to bunch and the pinnacle 29 to project unaesthetically outward.

Figure 3A:
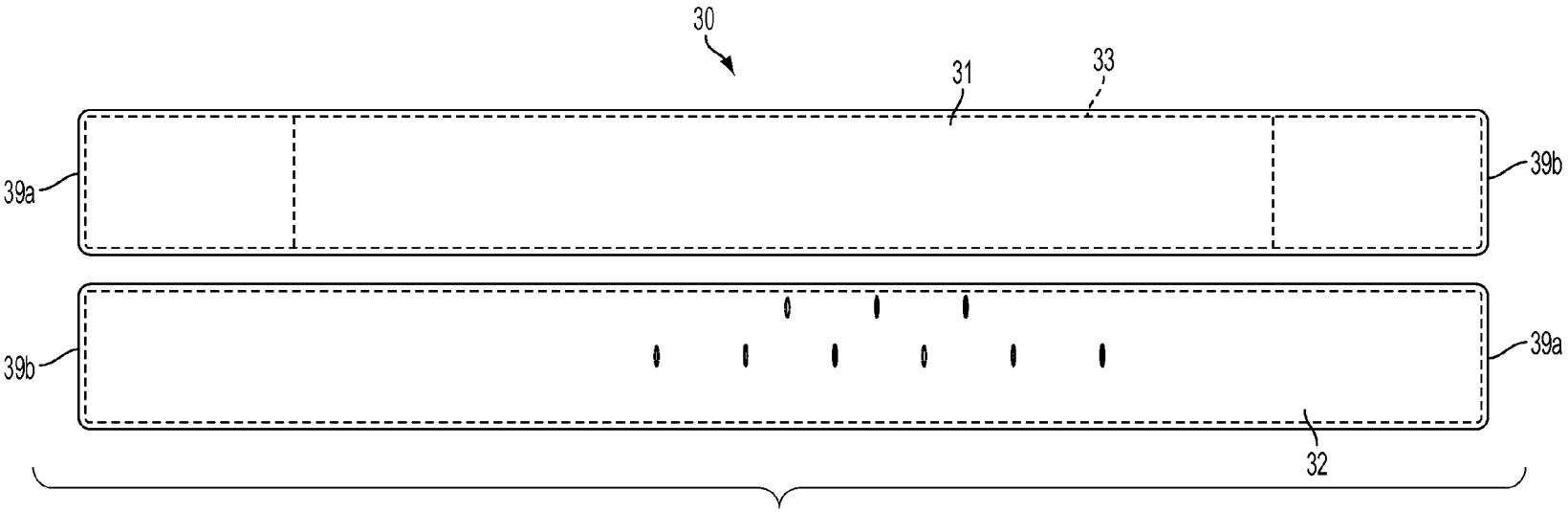
FIG. 3A shows front and rear views of an exemplary scarf portion in accordance with an exemplary aspect of the hood and scarf combination of FIG. 1.
Figure 3C:
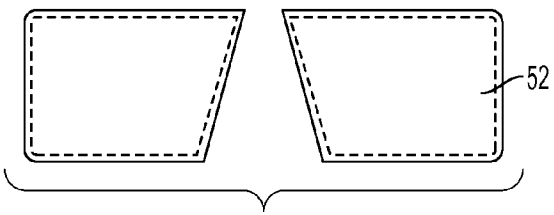
FIG. 3C shows a front view of left and right side pocket panels according to another exemplary aspect.
Figure 3B:
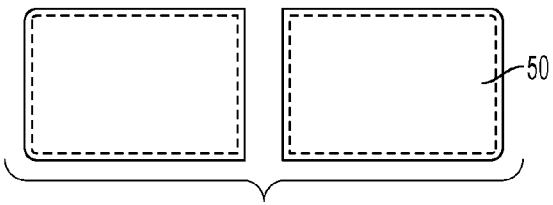
FIG. 3B shows a front view of left and right side pocket panels in accordance with an exemplary aspect of the hood and scarf combination of FIG. 1.

Referring now to FIGS. 3A-3C, components of a scarf portion 30 in accordance with aspects of the subject disclosure are shown. For sake of illustration, the general position of pocket panels are shown in broken lines without reference to shape or size in FIG. 3A. The scarf portion 30 may include an outer panel 31 and an inner panel 32. The inner panel 32 may be considered the attachment side for coupling the hood portion (not shown) to the scarf portion 30. A seam 33 defines the points of attachment of the outer panel 31 to the inner panel 32. The scarf portion 30 may also include first and second ends 39*a* and 39*b*. Referring to FIGS. 3B and 3B, pockets 50; 52 may be disposed on the ends of the scarf portion 30. Two exemplary styles of pockets are shown; a straight edged pocket 50 and a slanted edge pocket 52. Also, as shown in FIG. 3A, the scarf portion 30 is preferably substantially rectangular and that the length of the scarf portion 30 may be at least six times longer than its width.

Figure 4A:
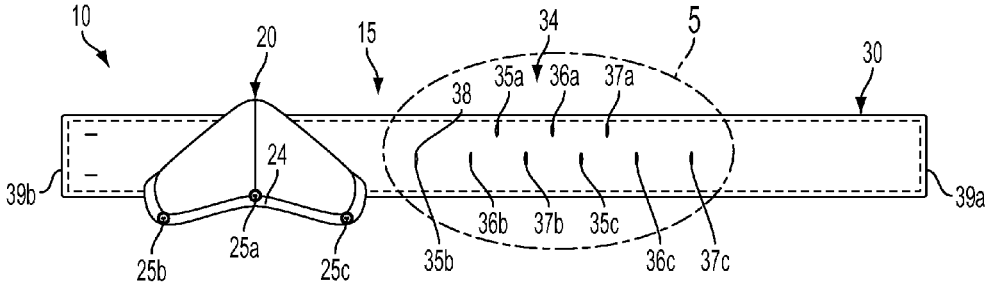
FIGS. 4A-4C are rear views of hoods juxtaposed in front of the attachment side of respective scarves illustrating various examples of fastener systems utilized to attach the hoods to the scarves in accordance with exemplary aspects of the subject disclosure.
Figure 4B:
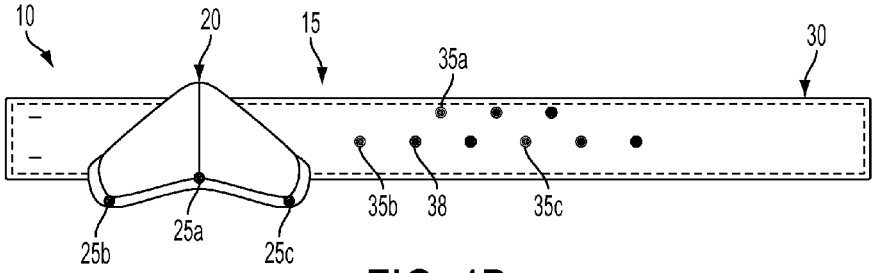
Figure 4C:
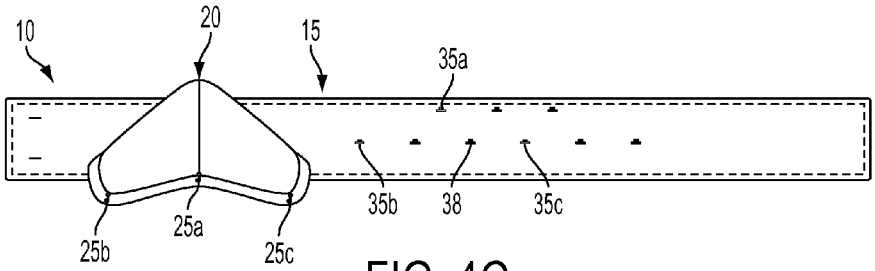
Figure 5:
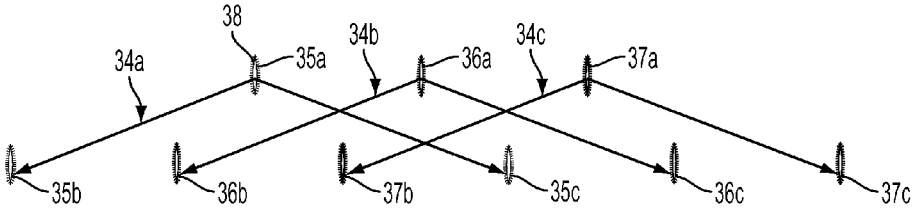
FIG. 5 is an enlarged view of sets of fasteners shown in the circle 5 of FIG. 4A.

Referring now to FIGS. 4A-4C and 5, various examples of fastening systems 15 employable on the hood and scarf combination 10 are shown. FIG. 4A illustrates the use of a button and buttonhole fastening system 15 as the fasteners 25 and fasteners 35 respectively. FIG. 4B illustrates an alternate embodiment using a snap system. FIG. 4C illustrates an alternate embodiment using a hook and eyes system as the fasteners 25 and fasteners 35 respectively where the eyes 35 may be elastic loops that may provide an added leeway to the connection of the hood portion 20 to the scarf portion 30. Furthermore, as shown in FIGS. 4A-4C, the that the scarf portion 30 is preferably substantially rectangular and that the length of the scarf portion 30 may be at least ten times longer than its width.

The fasteners 25 attached to the hood 20 may for example, include three fasteners designated 25*a*, 25*b*, and 25*c* for sake of illustration. The fastener 25*a* may be offset vertically or positioned non-linearly from other fasteners 25*b* and 25*c*. For example, 25*a*, 25*b*, and 25*c* may be arranged triangularly. In the exemplary embodiment shown, the fastener 25*a* is shown as the center fastener that is disposed on the apex 24.

In one aspect, the scarf 30 may include more fasteners 35 than fasteners 25 present on the hood 20. The fasteners 35 attached to the scarf 30 may be arranged in sets 34. A set 34 may comprise two or more fasteners 35. For example, a set 34*a* may comprise fasteners 35*a*, 35*b*, and 35*c*. Fastener 35*a* may be offset vertically or positioned non-linearly from fasteners 35*b* and 35*c* within the set 34*a*. For example, fasteners 35*a*, 35*b*, and 35*c* may be arranged triangularly so that fastener 35*a* is positioned on a higher latitude than fasteners 35*b* and 35*c*.

The scarf 30 may include more than one set 34. Sets 34 may be arranged linearly with respect to one another along the length of the scarf 30. For sake of illustration, three sets 34 are shown where individual sets 34*a*, 34*b*, and 34*c* are delineated as grouped by respective broken lines connecting fasteners 35 within a set 34 in FIGS. 4A and 5. For example, fasteners 35*a*, 35*b*, and 35*c* may comprise one set 34*a*, fasteners 36*a*, 36*b*, and 36*c* comprise another set 34*b*, and fasteners 37*a*, 37*b*, and 37*c* comprise another set 34*c*. The set 34*a* may be in a first position approximately centered along the length of the scarf 30. The set 34*b* may be in a second position laterally closer to the scarf end 39*a* than set 34*a*. Set 34*c* may be in a third position laterally closer to the scarf end 39*a* than set 34*b*. While the sets 34 are shown biased to the scarf end 39*b*, it will be understood that the sets 34 may be centered between the ends 39*a* and 39*b* so that the set 34*b* is positioned approximately equidistant from the ends 39*a* and 39*b*. In one aspect, the sets 34 may partially overlap one another so that, for example, fastener 36*b* may be positioned laterally between fasteners 35*a* and 35*b*. It will also be understood that in other exemplary embodiments the sets 34 may be positioned biased toward the end 39*a*.

The fasteners 25*a*, 25*b*, and 25*c* may be disposed to align with a set 34 when attaching the hood 20 to the scarf 30. Thus, in one exemplary attachment, the fastener 25*a* may be connected to the fastener 35*a*; the fastener 25*b* to the fastener 35*b*; and the fastener 25*c* to the fastener 35*c*. In another aspect, the hood portion 20 may be repositioned on the scarf portion 30 by laterally shifting the connection of the fasteners 25*a*-25*c* from fasteners 35*a*-35*c* to fasteners 36*a*-36*c* where 25*a* would correspondingly attach to fastener 36*a* and so on for fasteners 25*b* and 25*c* to fasteners 36*b* and 36*c*. Further lateral positioning of the hood portion 20 along the scarf 30 may be provided by connecting corresponding fasteners 25*a*-25*c* to corresponding fasteners 37*a*-37*c*.

In one aspect, the sets 34*a*, 34*b*, and 34*c* may be coded to provide ease of matching of respective fasteners 25*a*-25*c* to the fasteners 35*a*-35*c*, 36*a*-36*c*, or 37*a*-37*c*. For example, a fastener 35 on the scarf 30 may include a coded element 38. The coded element 38 may be a colored component. It will be understood that varying shades of black or dissimilar lines may represent varying colors in the disclosure. A set 34 may comprise fasteners 35 of the same coded element 38. For example, set 34*a* may include fasteners 35*a*, 35*b*, and 35*c* all using the same color. Set 34*b* may include fasteners 36*a*, 36*b*, and 36*c* using a different color than set 34*a*. In another aspect, fasteners 25 may be coded to correspond with fasteners 35 of aligned positions on the scarf 30. For example, fastener 25*a* may be coded to correspond with fasteners 35*a*, 36*a*, and 37*a*. Thus, in exemplary embodiments where fasteners 35 are coded, a user may be provided with ease of use in matching up respective fasteners 25 to intended sets 34 along the length of the scarf 30.

Figure 6A:
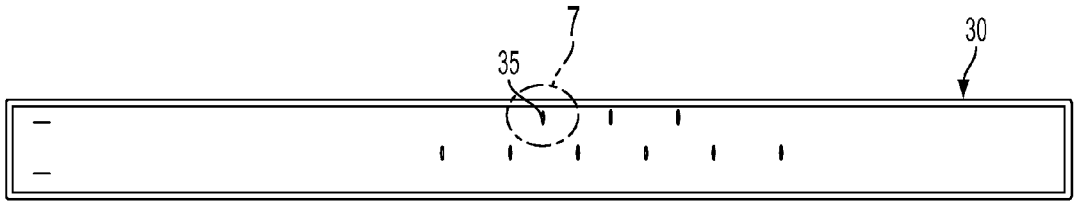
FIGS. 6A-6E are front views illustrating various exemplary fastener configurations for use with fastener systems in accordance with aspects of the subject disclosure.
Figure 6B:
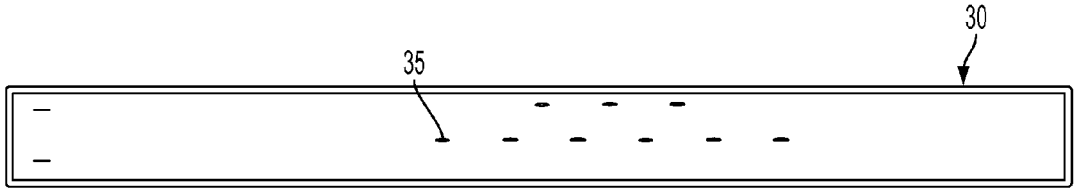
Figure 6C:
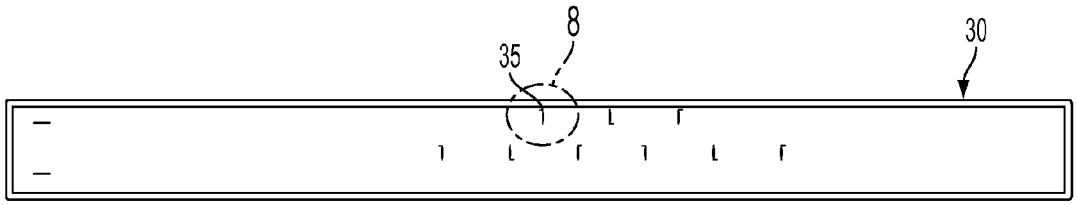
Figure 6D:
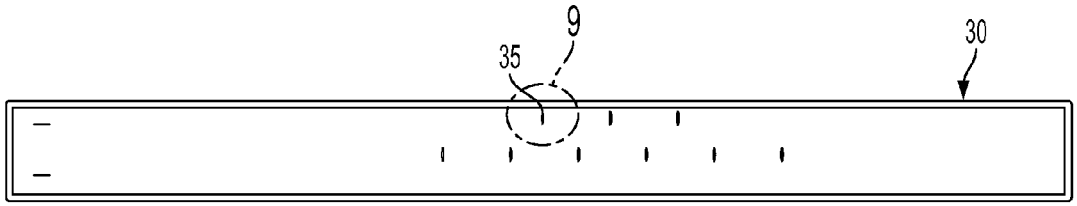
Figure 6E:
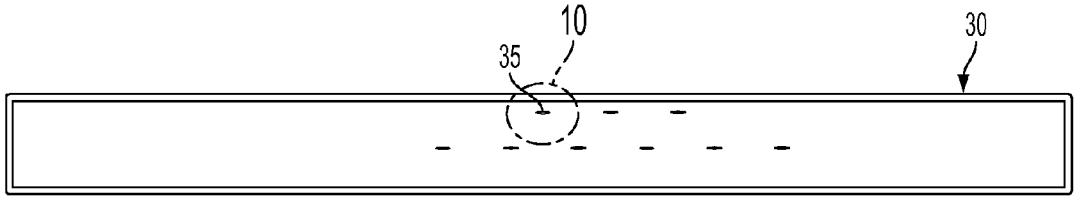
Figure 7:
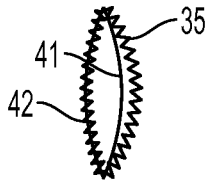
FIGS. 7-10 are enlarged views of circles 7-10 of FIGS. 6A-6E.
Figure 8:
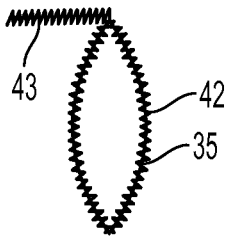
Figure 9:
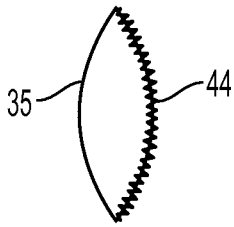
Figure 10:
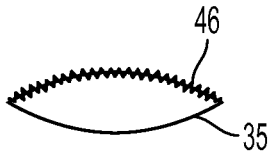

Referring now to FIGS. 6A-6E and 7-10 concurrently, additional exemplary fasteners 35 are shown. FIGS. 6A-6E respectively show aspects of coded fasteners 35. FIGS. 6A-6E are similar to the fastening systems 15 of FIGS. 4A-4E except for aspects that are disclosed in the following. Thus, for sake of illustration, common elements already disclosed in FIGS. 4A-4E may be omitted. FIG. 6A shows a fastener 35 configuration similar to the one shown in FIGS. 4A and 5. Referring now to FIG. 7, an enlarged view of a fastener 35 from FIG. 6A is shown. The fastener 35 may comprise a buttonhole including a stitch 42 circumventing the perimeter of the buttonhole. The stitch 42 may be color coded to provide accuracy in the attachment of a corresponding fastener 25 (FIG. 4A). The fastener 35 may also include an interface 41 providing reinforcement along the perimeter of the buttonhole. FIG. 6B shows another exemplary embodiment where the fasteners 35 are disposed as horizontal buttonholes. FIGS. 6C and 8 show another exemplary embodiment where the fasteners 35 include a stitching 42 surrounding the perimeter. The stitching 42 may be a uniform color for all the fasteners 35. The fastener 35 may also include a coded flagging stitch 43 along a point of the perimeter of the fastener 35. The flagging stitch may project out from the stitching 42 providing assistance for a user to align fasteners 25 to fasteners 35. FIGS. 6D and 6E are similar to FIGS. 6A and 6B respectively except that, as seen in FIGS. 9 and 10, the fasteners 35 include stitches 44 and 46 respectively that are stitched over a portion of the buttonhole perimeter. In these exemplary embodiments, the stitches 44 and 46 may also include a color code providing the aforementioned benefits.

Regarding the dimensions of the scarf portion 30, FIGS. 6A-6E shows that the length of the scarf portion 30 is much longer than the its width. Specifically, the length of the scarf portion 30 may be at least approximately ten times longer than its width. Additionally, the scarf portion 30 is preferably substantially rectangular.

Figure 11:
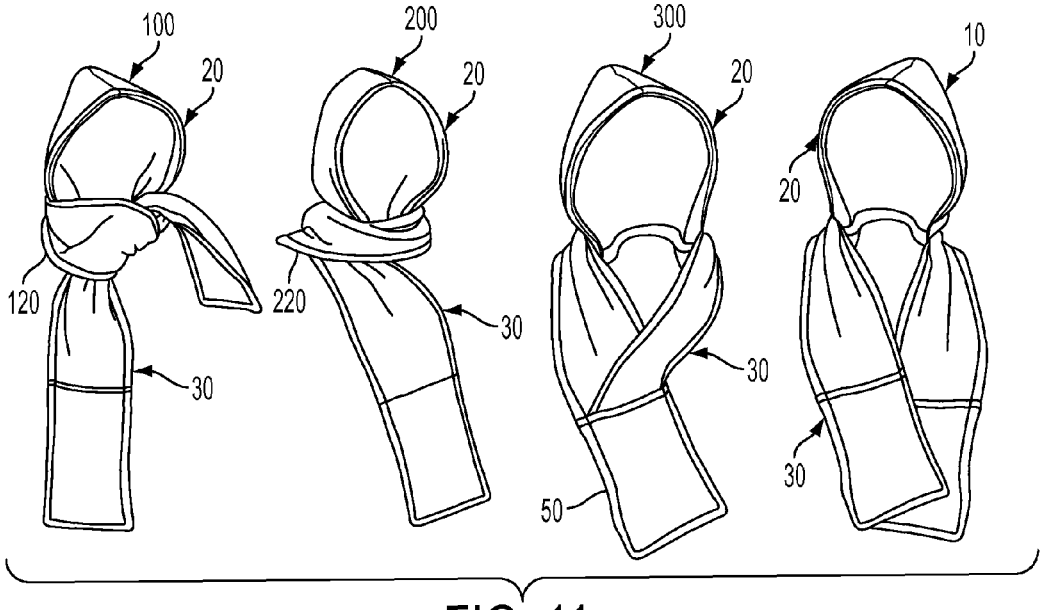
FIG. 11 is a collection of perspective views illustrating various positioning of a hood along a scarf attainable according to aspects of the subject disclosure.
Figure 2A:
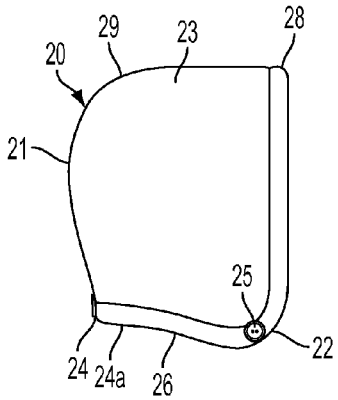
FIG. 2A is a right side view of an exemplary hood for use in the hood and scarf combination of FIG. 1.
Figure 2B:
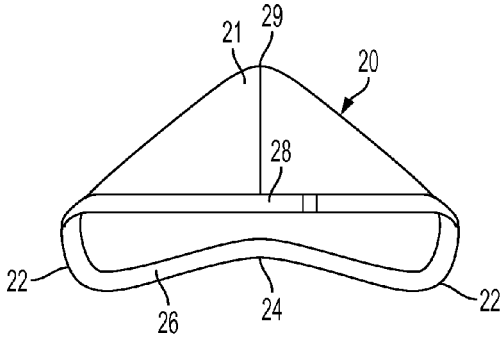
FIG. 2B is a front side view of an exemplary hood for use in the hood and scarf combination of FIG. 1.
Figure 2C:
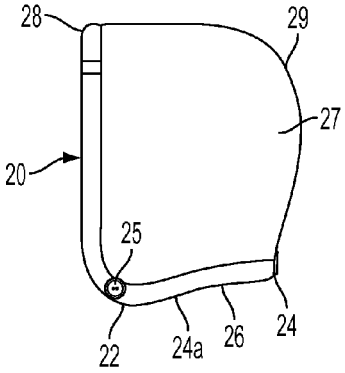
FIG. 2C is a left side view of an exemplary hood for use in the hood and scarf combination of FIG. 1.
Figure 2D:
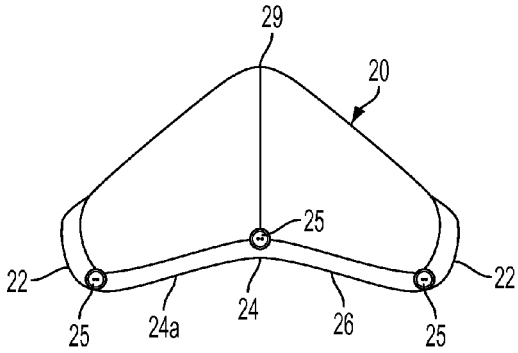
FIG. 2D is a rear view of an exemplary hood for use in the hood and scarf combination of FIG. 1.

Referring now to FIG. 11, exemplary embodiments of hood and scarf combinations 10, 100, 200, and 300 are shown. When assembled together, a user may position the scarf portion 30 around the neck of a user while maintaining attachment of the hood 20 by virtue of the aforementioned fastening systems. The hood and scarf combination 10 illustrates an approximately equal positioning of the scarf portion 30 to either side of the hood portion 20. The hood and scarf combinations 100 and 200 illustrate a displacement bias of the scarf portion 30 to the right of the hood 20. Positioning the center of the scarf portion 30 to one side of the hood 20 may allow a user to tie the left side of the scarf portion 30 into a knot 120 or to wrap the other side around the neck into a bundle 220 providing protection about the neck while maintaining an aesthetic hanging appearance on the right side. FIG. 11 also shows that the first end and second end of the scarf portion 30 may be tied into a knot while the hood portion is wrapped around the head of the user and while the scarf portion is wrapped around the neck of the user. While the embodiments illustrated have shown a bias to the right side, it will be understood that the scarf 30 may also be fastened to the hood portion 20 to bias the scarf portion to the left side of the hood. The hood and scarf combination 300 illustrates how the end of one side of the scarf portion 30 may be tucked into the pocket 50 of the opposing scarf end.

While the foregoing has been described as a singular pairing of a hood portion and scarf portion, it will be understood that an aspect of the subject disclosure can benefit users by providing a mix and matching of one style or color of a scarf portion to another style or color of a hood portion. Thus, scarf portions from various hooded scarves may be interchangeable with one another to form different hooded scarves.

Those of skill in the art would appreciate that various components and blocks may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims.

What is claimed is:

1. A hooded scarf, comprising:

a hood portion;

a plurality of fasteners on the hood portion;

a scarf portion; and a plurality of fasteners on the scarf portion;

wherein the scarf portion is substantially rectangular in shape with a length of the scarf portion to be approximately at least six times longer than a width of the scarf portion;

wherein the scarf portion includes a first end portion and a second end portion;

wherein the plurality of fasteners on the scarf portion is positioned laterally along the length of the scarf portion and approximately centered along the length of the scarf portion;

wherein the plurality of fasteners on the hood portion are configured to matingly engage with the plurality of fasteners on the scarf portion, such that the hood portion removeably attaches to the scarf portion;

wherein the plurality of fasteners on the hood portion is configured to removeably attach to the plurality of fasteners on the scarf portion, such that the hood portion is configured to reposition laterally on the scarf portion and approximately centered along the length of the scarf portion; and wherein the hooded scarf is configured to wrap around a neck and a head of a user, such that the scarf portion wraps around the neck of the user and the hood portion wraps around the head of the user while allowing the user to tie the first end portion and second end portion into a knot.

2. The hooded scarf of claim 1, wherein the hood portion is attachable to the scarf portion, positioned off-center along the length of the scarf portion.

3. The hooded scarf of claim 1, wherein the plurality of fasteners on the scarf portion includes at least one more fastener than the plurality of fasteners on the hood portion; and wherein the at least one more fastener on the scarf portion is positioned closer to the first end portion of the scarf than to the second end portion of the scarf and approximately centered along the length of the scarf portion.

4. The hooded scarf of claim 1, wherein the plurality of fasteners on the hood portion are arranged into a predetermined configuration, wherein the plurality of fasteners on the scarf portion are arranged into a plurality of predetermined sets of fasteners;

wherein each of the plurality of predetermined sets of fasteners on the scarf portion includes one fastener positioned non-linearly from a remaining fasteners of the each of the plurality of predetermined sets of fasteners; and wherein the plurality of predetermined sets of fasteners are positioned approximately centered along the length of the scarf portion at predetermined positions disposed for receipt of the plurality of fasteners on the hood portion.

5. A hooded scarf, comprising:

a hood portion;

one or more sets of fasteners attached to the hood portion;

a scarf portion; and one or more sets of fasteners attached to the scarf portion;

wherein the one or more sets of fasteners attached to the scarf portion are located approximately centered along the length of the scarf portion and laterally along a length of the scarf portion;

wherein the one or more sets of fasteners attached to the hood portion are arranged and configured to matingly engage with the one or more sets of fasteners attached to the scarf portion, such that the hood portion removeably attaches to the scarf portion; and wherein the one or more sets of fasteners attached to the hood portion is configured to removeably attach to the one or more sets of fasteners attached to the scarf portion, such that the hood portion is configured to reposition laterally on the scarf portion and approximately centered along the length of the scarf portion.

6. The hooded scarf of claim 5, wherein:

the hood portion includes a rear base edge including a first edge end and a second edge end and an edge apex disposed raised above the first edge end and the second edge end; and wherein each of the one or more sets of fasteners attached to the hood portion are three fasteners;

wherein the each of the one or more sets of fasteners attached to the hood portion are positioned on the edge apex, the first edge end, and the second edge end of the hood portion.

7. The hooded scarf of claim 5, wherein each of the one or more sets of fasteners attached to the hood portion are three fasteners; and wherein each of the one or more sets of fasteners attached to the scarf portion are three fasteners.

8. The hooded scarf of claim 7, wherein the three fasteners of each of the one or more sets of fasteners attached to the hood portion are arranged triangularly; and wherein the three fasteners of each of the one or more sets of fasteners attached to the scarf portion are arranged triangularly.

9. The hooded scarf of claim 8, wherein the scarf portion includes a first end and second end;

wherein the one or more sets of fasteners attached to the scarf portion is positioned closer to the second end of the scarf portion than the first end of the scarf portion.

10. The hooded scarf of claim 5, wherein the first end of the scarf portion includes a pocket; and wherein the second of the scarf portion includes a pocket.

11. The hooded scarf of claim 10, wherein the one or more sets of fasteners attached to the hood portion are color coded; and wherein the one or more sets of fasteners attached to the scarf portion are color coded.

12. A hooded scarf, comprising:

a hood;

two or more fasteners attached to the hood;

a scarf; and two or more sets of fasteners attached to the scarf, configured respectively to receive the two or more fasteners attached to the hood, wherein a first set of the fasteners attached to the scarf is disposed on a first position of the scarf, coded to designate the first position;

wherein a second set of the fasteners is disposed on a second position of the scarf, coded to designate the second position;

wherein the scarf is substantially rectangular in shape with a length of the scarf to be approximately at least six times longer than a width of the scarf;

wherein the scarf includes a first end portion and a second end portion;

wherein the first position is located approximately closer to the first end portion of the scarf;

wherein the second position is located approximately closer to the second end portion of the scarf;

wherein the two or more fasteners attached to the hood is configured to removeably attach to the two or more sets of fasteners attached to the scarf, such that the hood is configured to reposition laterally from the first position of the scarf to the second position of the scarf; and wherein the hooded scarf is configured to wrap around a neck and a head of a user, such that the scarf wraps around the neck of the user and the hood wraps around the head of the user while allowing the user to tie the first end portion and second end portion into a knot.

13. The hooded scarf of claim 12, wherein the two or more sets of fasteners attached to the scarf are color coded.

14. The hooded scarf of claim 13, wherein the two or more sets of fasteners attached to the scarf partially overlap along a length of the scarf.

15. The hooded scarf of claim 14, wherein at least one of the two or more sets of fasteners attached to the scarf is positioned closer to the second end of the scarf than the first end of the scarf.

16. The hooded scarf of claim 15, wherein:

one of the two or more fasteners on the hood is positioned above another of the two or more fasteners on the hood, one fastener is positioned above another fastener within respective sets of fasteners on the scarf; and the one of the two or more fasteners on the hood positioned above the other fastener on the hood is alignable to the one fastener positioned above the other fastener within respective sets of fasteners on the scarf while the other fastener on the hood is alignable with the other fastener within respective sets of fasteners on the scarf.

17. The hooded scarf of claim 16, further comprising a pocket on the first or second end of the scarf.

18. The hooded scarf of claim 17, wherein the pocket includes a slanted edge defining an entrance to the pocket.

* * * * *